US006979226B2

(12) United States Patent
Otsu et al.

(10) Patent No.: US 6,979,226 B2
(45) Date of Patent: Dec. 27, 2005

(54) CONNECTOR

(75) Inventors: Akihiko Otsu, Kanagawa (JP); Keiichi Azuma, Kanagawa (JP); Hiroshi Tokita, Kanagawa (JP); Noburo Nagashima, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/885,632

(22) Filed: Jul. 8, 2004

(65) Prior Publication Data

US 2005/0032430 A1 Feb. 10, 2005

(30) Foreign Application Priority Data

Jul. 10, 2003 (JP) ..... 2003-195330

(51) Int. Cl.[7] ..... H01R 13/648
(52) U.S. Cl. ..... 439/608; 439/108
(58) Field of Search ..... 439/607, 608, 439/609, 108, 101, 79, 701

(56) References Cited

U.S. PATENT DOCUMENTS

| | | | | |
|---|---|---|---|---|
| 6,293,827 | B1 * | 9/2001 | Stokoe | 439/608 |
| 6,347,962 | B1 * | 2/2002 | Kline | 439/608 |
| 6,471,549 | B1 * | 10/2002 | Lappohn | 439/608 |
| 6,551,140 | B2 * | 4/2003 | Billman et al. | 439/608 |
| 6,572,409 | B2 * | 6/2003 | Nitta et al. | 439/608 |

FOREIGN PATENT DOCUMENTS

| | | | |
|---|---|---|---|
| JP | 05-290916 | A | 11/1993 |
| JP | 07-006823 | A | 1/1995 |
| JP | 07-106027 | A | 4/1995 |
| JP | 2000-311749 | A | 11/2000 |
| JP | 2001-297831 | A | 10/2001 |
| JP | 2001-313109 | A | 11/2001 |

* cited by examiner

*Primary Examiner*—Hien Vu
(74) *Attorney, Agent, or Firm*—Rader, Fishman & Grauer PLLC

(57) ABSTRACT

The present invention relates to a connector which includes a plug unit and a receptacle. The plug unit includes a housing board and a transmission path board. The housing board has a housing board body and first connection terminals and second connection terminals. The transmission path board has a transmission path board body, plural differential signal patterns which are connected to the first connection terminals and the second connection terminals of the housing board, and high pass filters which are connected to each of the differential signal patterns. The receptacle has a receptacle body and pin contacts. According to the present invention, a low-frequency component of a digital signal is attenuated. Thus, since an attenuation factor of the high-frequency component and an attenuation factor of the low-frequency component of the digital signal can be set substantially the same, the digital signal can be transmitted surely.

8 Claims, 8 Drawing Sheets

CONNECTOR

CROSS-REFERENCE TO RELATED APPLICATIONS

This application is based upon and claims the benefit of priority from the prior Japanese Patent Application No. 2003-195330 filed on Jul. 10, 2003, the entire contents of which is incorporated herein by reference.

FIELD OF THE INVENTION

The present invention relates to a connector. In particular, the present invention relates to a connector which transmits signals between a daughterboard and a motherboard.

BACKGROUND OF THE INVENTION

Conventionally, there is known a connector which connects a daughterboard and a motherboard (e.g., see JP-A-7-6823). This connector includes a connector plug, which is attached to the daughterboard, and a connector receptacle in which this connector plug is fitted. This connector plug has a housing and plural transmission path blocks housed in this housing. These transmission path blocks are provided to be disposed at a predetermined interval.

These transmission path blocks are planar. Transmission path patterns are formed on one surface thereof, and ground patterns are formed on the other surfaces thereof. These transmission path patterns are micro strip lines formed of single transmission paths. A filter element is provided in each line.

The connector receptacle includes a housing and plural socket contacts housed inside this housing. These socket contacts are provided to be disposed at a predetermined interval. Each of the socket contacts is connected to each of the transmission path blocks.

According to such a connector, impedance matching and reduction in crosstalk can be realized, and noise can be reduced.

However, in recent years, there has been a demand for transmission of signals at low cost. Therefore, a differential signal system, which has a low voltage and a high noise resistance, has started to be used. A connector for differential signals having a micro strip line formed of a pair of transmission paths is used for this differential signal system.

However, even in the above-mentioned connector for differential signals, in the case in which a signal with a high frequency is transmitted, a phenomenon, in which a voltage level of a signal attenuates, may occur on the transmission paths due to an action of a conductor skin effect.

In particular, in the case in which a digital signal is transmitted, a phenomenon, in which a waveform of a signal which is originally a rectangular wave changes to a wave with delayed rising edge time, that is, a so-called dulled waveform, occurs on a reception side.

In addition, such a digital signal is a combination of a High signal "1" and a Low signal "0". Thus, the digital signal has, for example, a portion where signals of "1" or "0" continue as in "11110000" and a portion where reversal is repeated as in "1010". In this case, a sufficient reception level can be reserved in a portion where signals of the same level continue. However, in a portion where signals repeat reversal, it is likely that a signal is reversed due to a transient phenomenon before the signal reaches a predetermined signal level and a sufficient reception level cannot be reserved.

In addition, in the case in which a digital signal of several GHz is transmitted, in a reversed signal after signals of the same level continue, a signal level is smaller due to a conductor skin effect and a transient phenomenon as a frequency is higher or a transmission distance is longer. Jitters in this case are also increased, which causes a so-called code error.

SUMMARY OF THE INVENTION

In order to solve the above-mentioned problems, it is an object of the present invention to provide a connector which can transmit a digital signal surely.

The inventor has invented a new connector as described below in order to attain the object.

(1) A connector comprising: a plug unit for being attached to a daughterboard; and a receptacle for being attached to a motherboard and connected electrically to the plug unit; wherein the plug unit includes a housing board and a transmission path board which is attached to a surface of the housing board; wherein the housing board includes: an insulating housing board body of a rectangular planar shape: a first connection terminals which are provided along a first edge of the housing board body; and a second connection terminals which are provided along a second edge adjacent to the first edge of the housing board body; the transmission path board includes: a planar transmission path board body; plural differential signal patterns which are provided on a surface of the transmission path board body and connected to the first connection terminals and the second connection terminals of the housing board; and high pass filters which are provided in the transmission path board body and connected to each of the differential signal patterns; and wherein the receptacle includes: a receptacle body; and pin contacts which are provided in the receptacle body and to which the second connection terminals of the plug unit are connectable.

When the plug unit attached to the daughterboard and the receptacle attached to the motherboard are connected, a surface of the daughterboard and a surface of the motherboard are perpendicular to each other.

In the conventional connector, when a digital signal of several GHz is transmitted, since, in particular, a component with a high frequency attenuates largely, a digital waveform is dulled. In this case, if an amplifier is provided at an output terminal and only an attenuated high-frequency component is amplified by this amplifier, a waveform close to the digital waveform transmitted at an input terminal can be restored. However, since an amplifying IC excellent in high-frequency responsiveness is required in order to amplify such a high-frequency component, cost for a transmission system is increased.

Therefore, according to the invention of (1), the high pass filters are provided in the differential signal patterns of the transmission path board. That is, a high-frequency component of a digital signal is not amplified and a low-frequency component thereof is attenuated. Thus, since an attenuation factor of the high-frequency component and an attenuation factor of the low-frequency component of the digital signal can be set substantially the same, a waveform close to a waveform at an input terminal can be obtained at an output terminal as well. Therefore, although a reception voltage falls slightly, jitters are reduced, and an occurrence frequency of a digital error is reduced. As a result, the digital signal can be transmitted surely.

In addition, since equalizers (high pass filters) only have to be provided in the differential signal patterns, the connector can be reduced in size and can be manufactured at low cost.

Since the number of plug units to be attached to the receptacle can be adjusted to an arbitrary number, a degree of freedom of design for the connector can be improved compared with the conventional connector.

(2) The connector described in (1), wherein each of the differential signal patterns consist of pairs of signal transmission paths, and wherein the high pass filters consist of resistors and capacitors which are connected in parallel to each of the pairs of signal transmission paths.

(3) The connector described in (2), wherein the resistors and the capacitors which consist the high pass filters are integrally formed.

(4) The connector described in (1), wherein plural fitting grooves are formed at the first edge of the housing board, and wherein the first connection terminals include: shoulder portions which are pressed in the fitting grooves of the housing board; tab portions which are provided in the shoulder portions and connected to the daughterboard; and tail portions which are provided in the shoulder portions and fixed to the differential signal patterns of the transmission path board.

(5) The connector described in (1), wherein plural fitting grooves are formed at the second edge of the housing board, and, wherein the second connection terminals include: shoulder portions which are pressed in the fitting grooves of the housing board; nipping portions which are provided in the shoulder portions and nip pin contacts of the receptacle; and tail portions which are provided in the shoulder portions and fixed to the differential signal patterns of the transmission path board.

(6) The connector described in (1), wherein the plug unit further includes a ground board which is attached to a surface of the housing board opposite to the transmission path board, and wherein the ground board includes: a planar ground board body; plural first ground contacts which are provided in the ground board body and disposed adjacent to the first connection terminals of the housing board; plural second ground contacts which are provided in the ground board body and disposed adjacent to the second connection terminals of the housing board; and plural connection pins which are vertically provided on a surface of the ground board, wherein the transmission path board includes: first ground patterns provided between adjacent differential signal patterns; second ground patterns provided on a surface of the transmission path board body opposite to the first ground patterns; and through-holes which connect the first ground patterns and the second ground patterns, and wherein the connection pins of the ground board inserted in the through-holes of the transmission path board through pierced holes of the housing board.

According to the invention of (6), since a rear surface of the transmission path board is covered by the ground board, the transmission path board can be shielded from noise in the outside.

In addition, since the first ground contacts are disposed adjacent to the first connection terminals of the housing board, electromagnetic radiation noise due to a signal from the first connection terminals can be controlled. Further, since the second ground contacts are disposed adjacent to the second connection terminals of the housing board, crosstalk of a signal form the second connection terminals and other signals can be controlled.

Moreover, when the connections pins of the ground board are pierced through the housing board, pressed in the through-holes of the transmission path board, and soldered, the transmission path board and the ground board are formed integrally with the housing board.

(7) The connector described in (6), wherein the plug unit further includes an insulating cover housing which covers the transmission path board.

(8) The connector described in (7), wherein the plug unit is connectable to the second connection terminals of the receptacle in a state in which plural plug units are stacked.

DETAILED DESCRIPTION OF THE PREFERRED EMBODIMENT

Figure 1C:
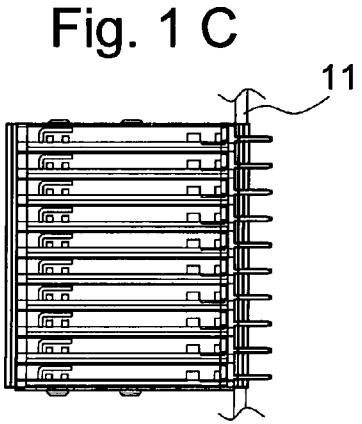
FIG. 1C is a plan view of the transmission system in accordance with the embodiment.
Figure 1A:
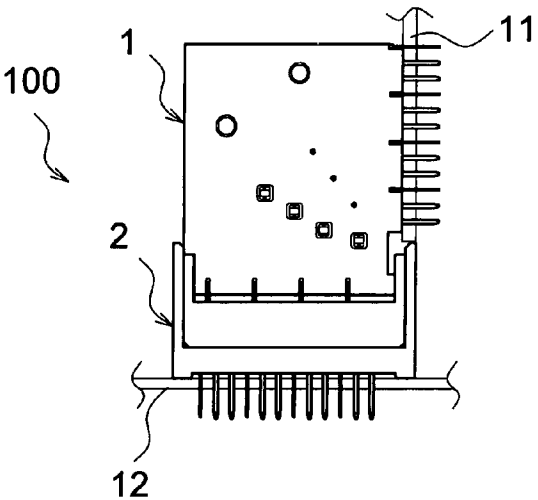
FIG. 1A is a front view of a transmission system to which a connector in accordance with an embodiment of the present invention is applied.
Figure 1B:
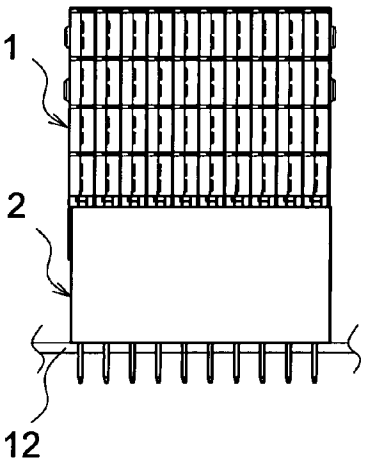
FIG. 1B is a side view of the transmission system in accordance with the embodiment.

FIG. 1A is a front view of a transmission system to which a connector 100 in accordance with an embodiment of the present invention is applied. FIG. 1B is a side view of the transmission system. FIG. 1C is a plan view of the transmission system.

The transmission system includes a motherboard 12, a daughterboard 11 which is disposed perpendicular to this mother board, and a connector 100 which connects the motherboard 12 and the daughterboard 11.

The connector 100 includes plural stacked plug units 1 which are attached to a not-shown transmission path of the daughterboard 11 and a receptacle 2 to which the plug units 1 attached to a not-shown transmission path of the motherboard 12 are electrically connected.

Note that there are plural daughterboards. For example, a differential signal is sent from one daughterboard 11, and another daughterboard 11 receives this differential signal via the motherboard 12.

Figure 2:
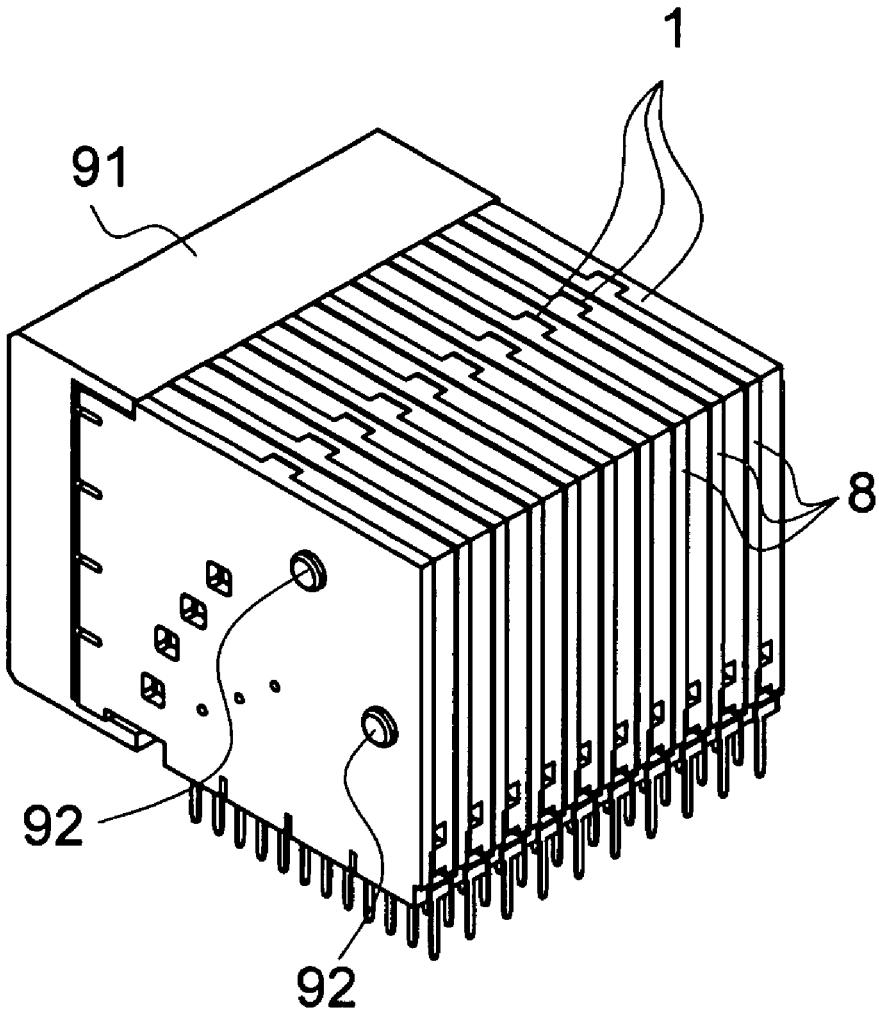
FIG. 2 is a perspective view showing a state in which plural plug units in accordance with the embodiment are stacked.

FIG. 2 is a perspective view showing a state in which the plural plug units 1 are stacked.

Ten plug units 1 are stacked and coupled with each other by bolts 92. An insulating cap housing 91 is attached to a receptacle 2 side of the plug unit 1.

Figure 3:
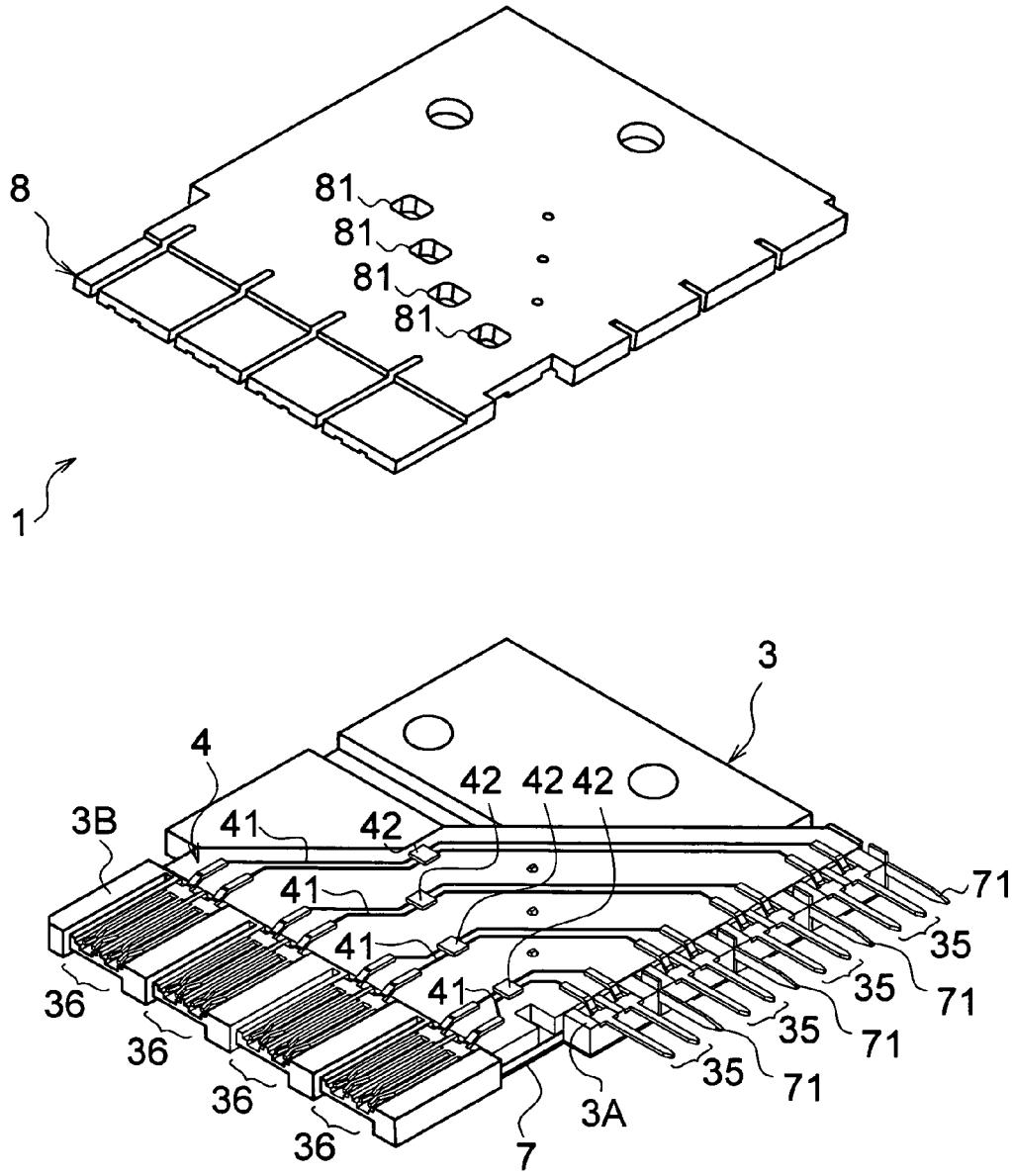
FIG. 3 is a perspective view showing the plug unit in accordance with the embodiment.

FIG. 3 is a perspective view showing the plug unit 1.

The plug unit 1 includes a housing board 3, a transmission path board 4 which is attached to a surface of the housing board 3, an insulating cover housing 8 which covers this transmission path board 4, and a ground board 7 which is attached to a surface of the housing board 3 opposite to the transmission path board 4.

Figure 4:
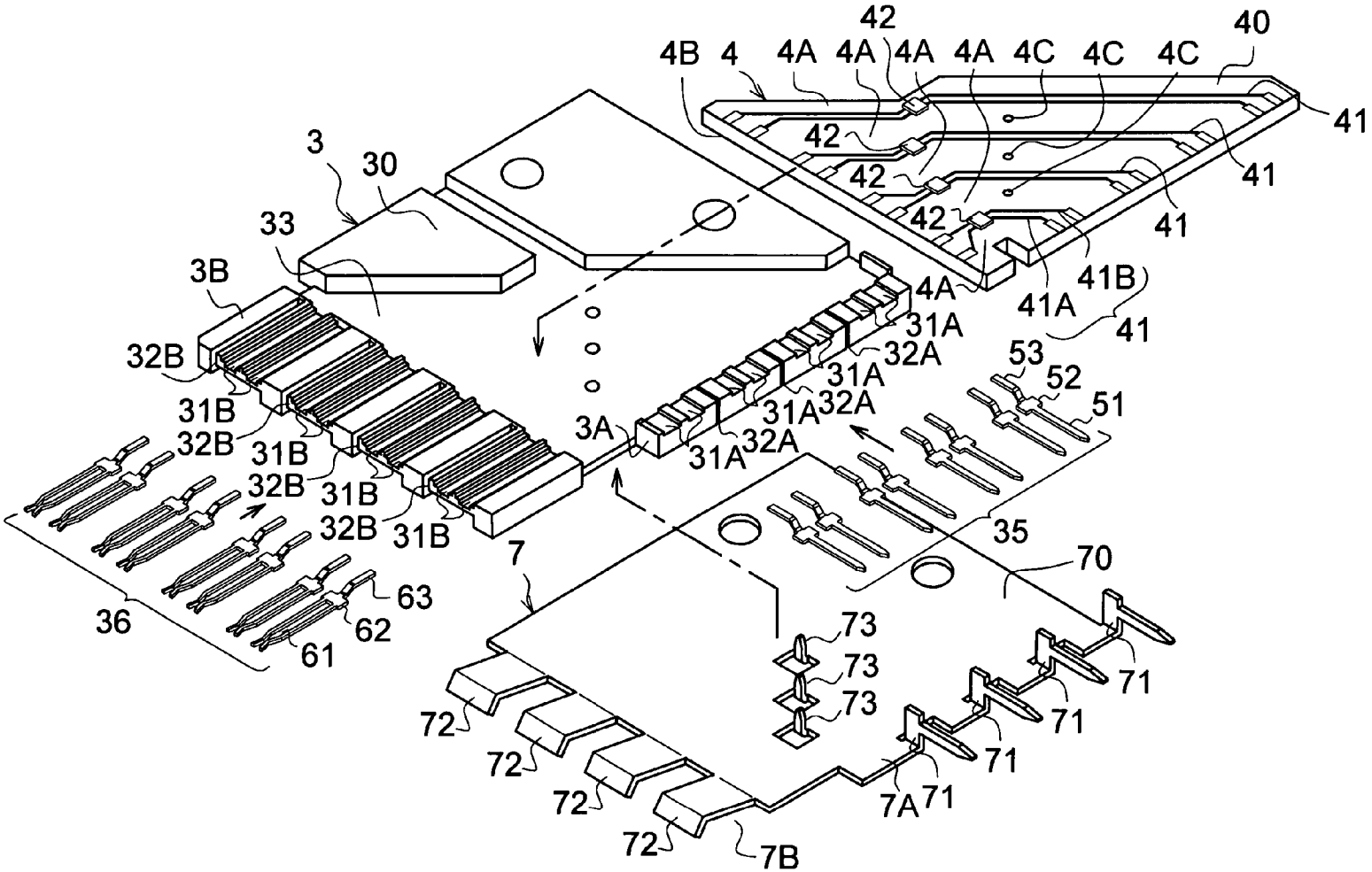
FIG. 4 is a disassembled perspective view of the plug unit in accordance with this embodiment.

FIG. 4 is a disassembled perspective view of the plug unit 1.

The housing board 3 has an insulating housing board body 30 of a rectangular planar shape, first connection terminals 35 which are provided along a first edge 3A of this housing board body 30, and second connection terminals 36 which are provided along a second edge 3B adjacent to the first edge 3A of the housing board body 30. The first connection terminals 35 are attached to the daughterboard 11.

A recess 33 of a substantially right triangle shape is formed in the housing board 3, and the transmission path board 4 is fitted in this recess 33.

In addition, plural fitting grooves 31A are formed at a fixed interval on the first edge 3A. These fitting grooves 31A are provided in association with plural differential signal patterns 41 described later of the transmission path board 4. In other words, a pair of fitting grooves 31A is provided for one differential signal pattern 41. Cutout grooves 32A are formed between the adjacent fitting grooves 31A corresponding to the different differential signal patterns 41.

Further, plural fitting grooves 31B of a reverse projection shape are formed at a fixed interval at the second edge 3B of the housing board 3. These fitting grooves 31B are provided in association with plural differential signal patterns 41 described later of the transmission path board 4. In other words, a pair of fitting grooves 31B is formed for one differential signal pattern 41. Cutout grooves 32B are formed between the adjacent fitting grooves 31 corresponding to the different differential signal patterns 41.

The connection terminals 35 include shoulder portions 52 which are pressed in the fitting grooves 31A of the housing board 3, tab portions 51 which are provided in these shoulder portions 52 and attached to the daughterboard 11, and tail portions 53 which are provided in the shoulder portions 52 and fixed to the differential signal patterns 41 of the transmission path board 4 by soldering.

The second connection terminals 36 include shoulder portions 62 which are pressed in the fitting grooves 31B of the housing board 3, nipping portions 61 which are provided in these shoulder portions 62 and nip pin contacts 21 of the receptacle 2 described later, and tail portions 63 which are provided in the shoulder portions 62 and fixed to the differential signal patterns 41 of the transmission path board 4 by soldering.

The transmission path board 4 has a transmission path board body 40 of a planar substantially triangular shape, plural differential signal patterns 41 which are provided on a surface of this transmission path board body 40 and connected to the first connection terminals 35 and the second connection terminals 36 of the housing board 3, and high pass filters 42 which are provided in the transmission path board body 40 and connected to each of the differential signal patterns 41.

In addition, the transmission path board 4 includes first ground patterns 4A which are provided between the adjacent differential signal patterns 41 on the surface of the transmission path board body 40, second ground patterns 4B which are provided on a surface of the transmission path board body 40 opposite to the first ground patterns 4A, and through-holes 4C which connect the first ground patterns 4A and the second ground patterns 4B.

The differential signal patterns 41 are provided at a predetermined interval and consist of a pair of signal transmission paths 41A, 41B.

Figure 5:
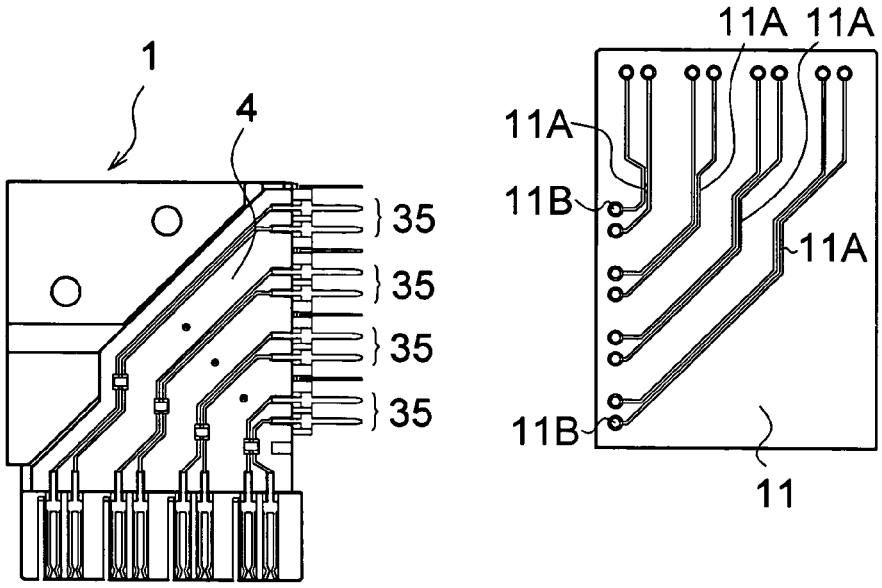
FIG. 5 is a plan view of a transmission path board and a daughterboard in accordance with the embodiment.

FIG. 5 is a plan view of the transmission path board 4 and the daughterboard 11.

Since the signal transmission paths 41A, 41B of the transmission path board 4 have different lengths, phase shift of skew occurs. Thus, the phase shift of skew due to the difference of the lengths of the signal transmission paths 41A, 41B is corrected by differential signal patterns 11A of the daughterboard 11.

In addition, since discontinuity occurs in impedance, a signal transmission path cannot be bent at an angle of 90 degrees. Thus, the signal transmission paths 41A, 41B are bent at an angle of about 45 degrees. Plural through-holes 11B are formed at terminal ends of the differential signal patterns 11A of the daughterboard 11, and the first connection terminals 35 are connected to these through-holes 11B.

Figure 6:
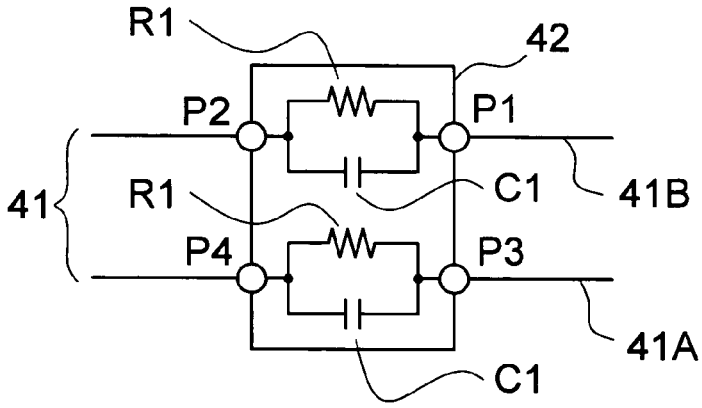
FIG. 6 is a circuit diagram of a high pass filter in accordance with the embodiment.

FIG. 6 is a circuit diagram of the high pass filter 42.

The high pass filter 42 consists of resistors R1 and capacitors C1 which are connected in parallel to each of the signal transmission paths 41A, 41B.

Note that, in order to make the high pass filter 42 fine, the resistors R1 and the capacitors C1 are formed as elements, respectively, and are formed integrally. In other words, the high pass filter 42 has bump terminals P1 to P4, which are connected to the signal transmission paths 41A, 41B, respectively.

A high-frequency component of a digital signal is not amplified and a low-frequency component thereof is attenuated by this high pass filter 42. Thus, since an attenuation factor of the high-frequency component and an attenuation factor of the low-frequency component of the digital signal can be set substantially the same, a-waveform close to a waveform at an input terminal can be obtained at an output terminal as well. Therefore, although a reception voltage falls slightly, jitters are reduced, and an occurrence frequency of a digital error is reduced. As a result, the digital signal can be transmitted surely.

Referring back to FIG. 3, the thin cover housing 8 has substantially the same shape as the housing board 3 and is attached to the housing board 3 so as to cover the differential signal patterns 41 of the transmission path board 4. Plural element housing portions 81, in which the high pass filters 42 are housed, are formed in the cover housing 8 to realize reduction in thickness for the plug unit.

As shown in FIG. 4, the ground board 7 includes a ground board body 70 having a shape substantially identical with that of the housing board 3, plural first ground contacts 71 which are provided in this ground board body 70 and disposed adjacent to the first connection terminals 35 of the housing board 3, plural second ground contacts 72 which are provided in the ground board body 70 and disposed adjacent to the second connection terminals 36 of the housing board 3, and plural connection pins 73 which are vertically provided on a surface of the ground board body 70.

Connection pins 73 of the ground board 7 are inserted into through-holes 4C of the transmission path board 4 through pierced holes of the housing board 3.

The ground board body 70 is formed of one board member. The first ground contacts 71 are formed by partially bending the board member forming the ground board body 70. These first ground contacts 71 are inserted into the cutout grooves 32A of the housing board 3 and disposed at the first edge 3A of the housing board 3.

On the other hand, the second ground contacts 72 are formed by partially bending the board member forming the ground board body 70. These second ground contacts 72 are disposed at the second edge 3B of the housing board 3.

Figure 7:
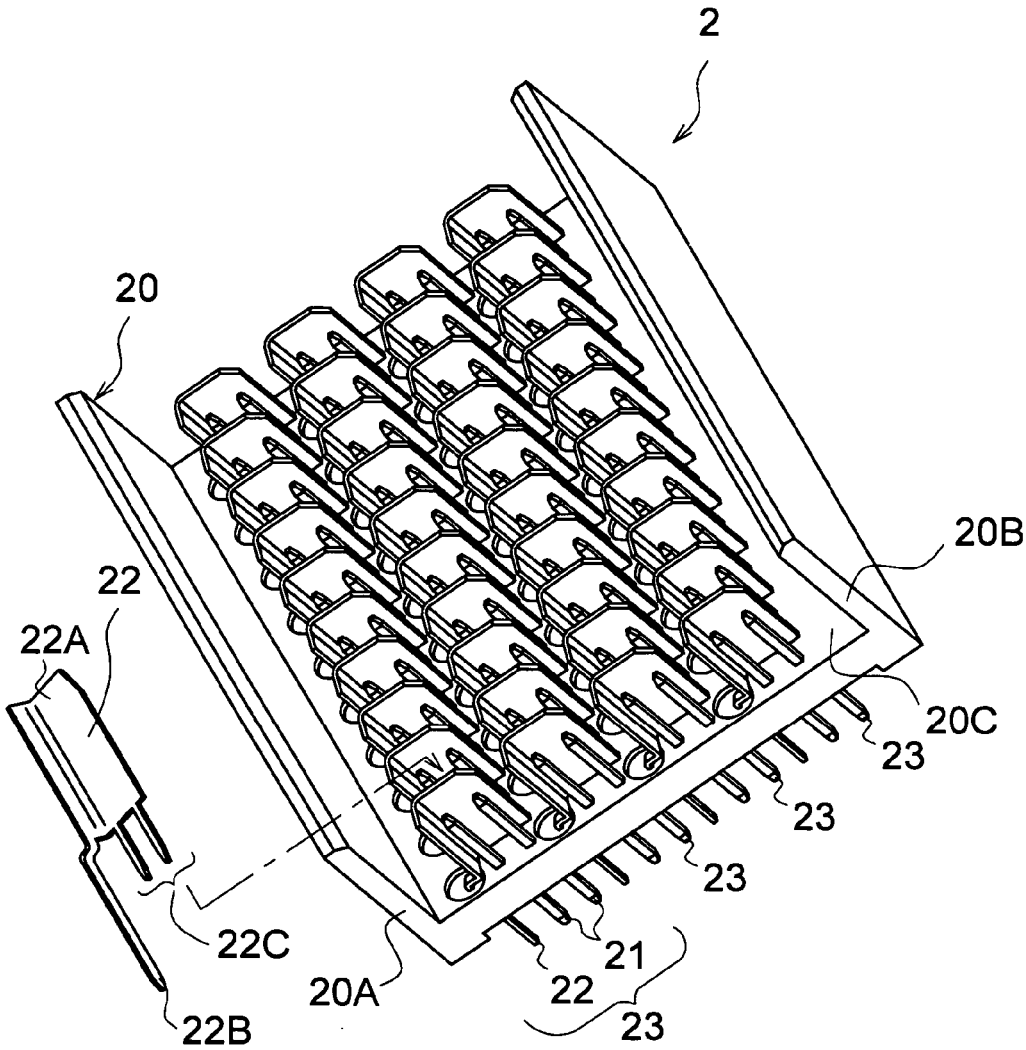
FIG. 7 is a perspective view of a receptacle in accordance with the embodiment.

FIG. 7 is a perspective view of the receptacle 2.

The receptacle 2 has a receptacle body 20 having a square bracket shape in section and third connection terminals 23 to which the second connection terminals 36 and the second ground contacts 72 of the plug unit 1 are connectable. These third connection terminals 23 are attached to the motherboard 12 described later.

The receptacle body 20 has a bottom surface 20C and collars 20A, 20B which are vertically provided at both ends of this bottom surface 20C. Plural openings are formed in the bottom surface 20C, and the third connection terminals 23 are pressed in these openings.

The third connection terminals 23 include pairs of pin contacts 21 to which the second connection terminals 36 of the plug unit 1 are connectable and third ground contacts 22 to which the second ground contacts 72 of the plug unit 1 are connectable.

The third ground contact 22 consists of a tab 22A formed in an L shape in section, one pin portion 22B extending from this tab 22A, and two press-in terminals 22C extending in parallel from the tab 22A to the pin portion 22B.

By pressing the press-in terminals 22C in holes formed in the bottom surface 20C, the third ground contact 22 is fixed to the receptacle body 20 so as to surround the pair of pin contacts 21, and the pin portions 22B project to the outside of the receptacle body 20.

Next, a procedure for connecting the plural stacked plug units 1 to the receptacle body 20 will be explained.

Figure 8:
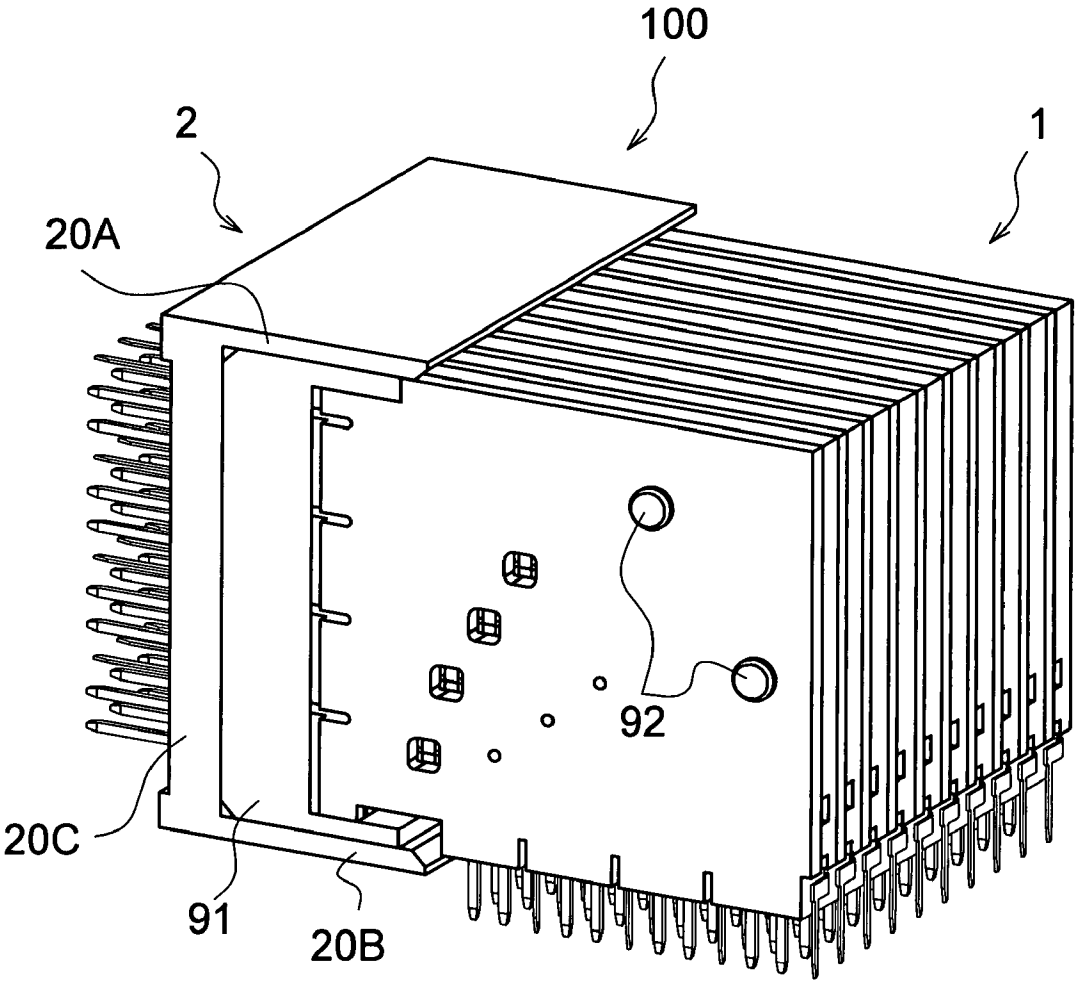
FIG. 8 is a view for explaining a procedure for connecting the plug unit in accordance with the embodiment to the receptacle.

First, the ten plug units 1 are coupled by the bolts 92 to attach the cap housing 91 thereto. Next, as shown in FIG. 8, these plug units 1 are inserted into the receptacle 2. Then, the cap housing 91 is guided by the collars 20A, 20B of the receptacle body 20 to be connected to the receptacle 2. That is, one piece of the tab 22A is nipped by the second ground contact 72 of the ground board 7 and the second edge 3B of the housing board 3. The other piece of the tab 22A is inserted into the cutout groove 32B of the housing board 3.

Figure 9B:
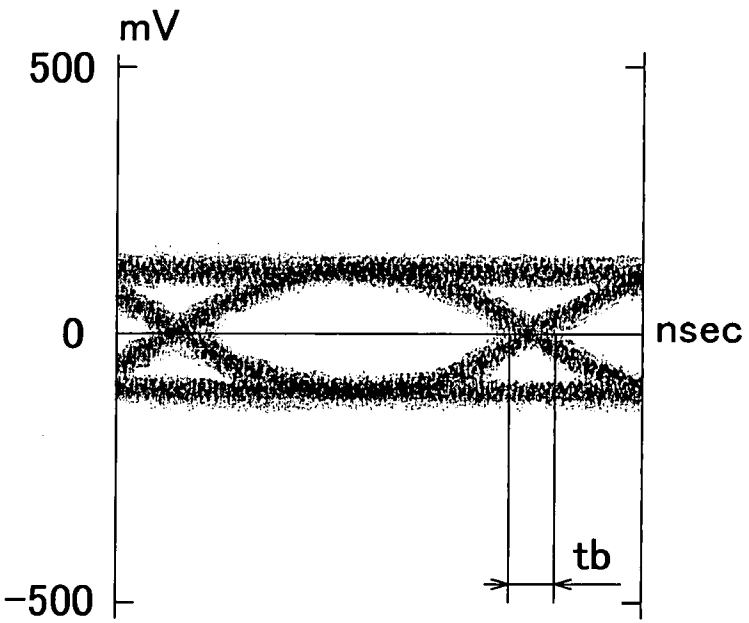
FIG. 9B is a diagram showing an eye pattern in the case that high pass filters are provided in a connector.
Figure 9A:
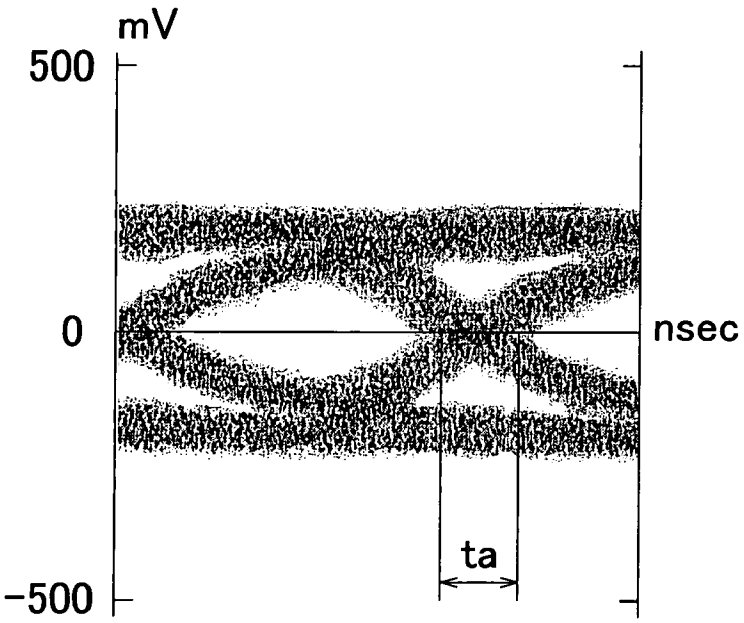
FIG. 9A is a diagram showing an eye pattern in the case that high pass filters are not provided in a connector.

Next, as an example, jitters in differential signals were compared by eye pattern measurement. FIG. 9A is a diagram showing an eye pattern in the case in which high pass filters are not provided in a connector, and FIG. 9B is a diagram showing an eye pattern in the case in which high pass filters are provided in a connector. Note that, in FIGS. 9A, 9B, a vertical axis indicates amplitude [mV] and a horizontal axis indicates time [nsec].

More specifically, a differential signal of 3 GHz was inputted and was measured with a wiring length of 30 inches. Then, as shown in FIG. 9A, in the case in which high pass filters were not provided, a jitter "ta" was 150 [psec] . On the other hand, as shown in FIG. 9B, in the case in which high pass filters were provided, a jitter "tb" was 75 [psec] . Therefore, it was found that a jitter could be reduced by 50% by providing high pass filters in a connector.

According to the connector of the present invention, there are advantages as described below.

High pass filters are provided in differential signal patterns of a transmission path board. That is, a high-frequency component of a digital signal is not amplified and a low-frequency component thereof is attenuated. Thus, since an attenuation factor of the high-frequency component and an attenuation factor of the low-frequency component of the digital signal can be set substantially the same, a waveform close to a waveform at an input terminal can be obtained at an output terminal as well. Therefore, although a reception voltage falls slightly, jitters are reduced, and an occurrence frequency of a digital error is reduced. As a result, the digital signal can be transmitted surely.

In addition, since equalizers (high pass filters) only have to be provided in the differential signal patterns, the connector can be reduced in size and can be manufactured at low cost.

Further, since the number of plug units to be attached to the receptacle can be adjusted to an arbitrary number, a degree of freedom of design for the connector can be improved compared with the conventional connector.

What is claimed is:

1. A connector comprising:

a plug unit for being attached to a daughterboard; and a receptacle for being attached to a motherboard and connected electrically to the plug unit;

wherein the plug unit includes a housing board and a transmission path board which is attached to a surface of the housing board;

wherein the housing board includes: an insulating housing board body of a rectangular planar shape: a first connection terminals which are provided along a first edge of the housing board body; and a second connection terminals which are provided along a second edge adjacent to the first edge of the housing board body;

the transmission path board includes: a planar transmission path board body; plural differential signal patterns which are provided on a surface of the transmission path board body and connected to the first connection terminals and the second connection terminals of the housing board; and high pass filters which are provided in the transmission path board body and connected to each of the differential signal patterns; and wherein the receptacle includes: a receptacle body; and pin contacts which are provided in the receptacle body and to which the second connection terminals of the plug unit are connectable.

2. The connector according to claim 1, wherein each of the differential signal patterns consist of pairs of signal transmission paths, and wherein the high pass filters consist of resistors and capacitors which are connected in parallel to each of the pairs of signal transmission paths.

3. The connector according to claim 2, wherein the resistors and the capacitors which consist the high pass filters are integrally formed.

4. The connector according to claim 1, wherein plural fitting grooves are formed at the first edge of the housing board, and wherein the first connection terminals include: shoulder portions which are pressed in the fitting grooves of the housing board; tab portions which are provided in the shoulder portions and connected to the daughterboard; and tail portions which are provided in the shoulder portions and fixed to the differential signal patterns of the transmission path board.

5. The connector according to claim 1, wherein plural fitting grooves are formed at the second edge of the housing board, and, wherein the second connection terminals include: shoulder portions which are pressed in the fitting grooves of the housing board; nipping portions which are provided in the shoulder portions and nip pin contacts of the receptacle; and tail portions which are provided in the shoulder portions and fixed to the differential signal patterns of the transmission path board.

6. The connector according to claim 1, wherein the plug unit further includes a ground board which is attached to a surface of the housing board opposite to the transmission path board, and wherein the ground board includes: a planar ground board body; plural first ground contacts which are provided in the ground board body and disposed adjacent to the first connection terminals of the housing board; plural second ground contacts which are provided in the ground board body and disposed adjacent to the second connection terminals of the housing board; and plural connection pins which are vertically provided on a surface of the ground board, wherein the transmission path board includes: first ground patterns provided between adjacent differential signal patterns; second ground patterns provided on a surface of the transmission path board body opposite to the first ground patterns; and through-holes which connect the first ground patterns and the second ground patterns, and wherein the connection pins of the ground board inserted in the through-holes of the transmission path board through pierced holes of the housing board.

7. The connector according to claim 6, wherein the plug unit further includes an insulating cover housing which covers the transmission path board.

8. The connector according to claim 7, wherein the plug unit is connectable to the second connection terminals of the receptacle in a state in which plural plug units are stacked.

* * * * *